US008261434B2

(12) United States Patent
Bartelmuss et al.

(10) Patent No.: US 8,261,434 B2
(45) Date of Patent: Sep. 11, 2012

(54) DEVICE FOR RELEASABLY FASTENING A WIRE FOIL IN AN INSTALLATION FOR PRODUCING PAPER

(76) Inventors: Klaus Bartelmuss, Teufenbach (AT); Heinz Bartelmuss, Teufenbach (AT)

( * ) Notice: Subject to any disclaimer, the term of this patent is extended or adjusted under 35 U.S.C. 154(b) by 405 days.

(21) Appl. No.: 12/612,418

(22) Filed: Nov. 4, 2009

(65) Prior Publication Data

US 2010/0154209 A1 Jun. 24, 2010

(30) Foreign Application Priority Data

Dec. 18, 2008 (AT) ..... 1977/2008

(51) Int. Cl.
*B23P 19/00* (2006.01)

(52) U.S. Cl. ..... 29/822; 29/819; 29/525.01; 269/139; 269/291; 269/309; 162/352

(58) Field of Classification Search ..... 29/819, 29/525.01, 822; 269/289 R, 291, 309–310, 269/139; 162/352
See application file for complete search history.

(56) References Cited

U.S. PATENT DOCUMENTS 3,953,284 A * 4/1976 Evalahti ..... 162/352
* cited by examiner

*Primary Examiner* — Derris Banks
*Assistant Examiner* — Azm Parvez
(74) *Attorney, Agent, or Firm* — Laurence A. Greenberg; Werner H. Stemer; Ralph E. Locher

(57) ABSTRACT

A device for releasably fastening a wire foil to a supporting strip in an installation for producing paper. The installation has a wire and wire foils that extend transversely with respect to the movement direction of the wire. The foils are situated at a spacing from one another in the movement direction of the wire and come into contact with the wire. Supporting strips for the wire foils are assigned to the wire foils and likewise extend transversely with respect to the movement direction of the wire. The wire foils or the supporting strips which are assigned to them are configured in their longitudinal direction with an undercut groove, and the supporting strips or the wire foils are configured with a spring which corresponds to the cross section of the undercut groove. It is possible for the wire foils to be pushed with play onto the supporting strips transversely with respect to the movement direction of the wire, with the result that, in their operating position, they are fastened releasably to the supporting strips. A clamping strip which extends in the longitudinal direction of the supporting strip and the wire foil is provided between the supporting strip and the wire foil, the displacement of the clamping strip in its longitudinal direction bringing about a transverse movement of the wire foil with respect to the supporting strip, as a result of which the wire foil is connected rigidly in its operating position to the supporting strip.

12 Claims, 7 Drawing Sheets

DEVICE FOR RELEASABLY FASTENING A WIRE FOIL IN AN INSTALLATION FOR PRODUCING PAPER

CROSS-REFERENCE TO RELATED APPLICATION

This application claims the priority, under 35 U.S.C. §119, of Austrian patent application A 1977/2008, filed Dec. 18, 2008; the prior application is herewith incorporated by reference in its entirety.

BACKGROUND OF THE INVENTION

Field of the Invention

The invention relates to a device for releasably fastening a wire foil to a supporting strip in a paper production installation. The installation has a wire, wire foils which, furthermore, extend transversely with respect to the movement direction of the wire, are situated at a spacing from one another in the movement direction of the wire and with which the wire comes into contact, and supporting strips for the wire foils, which supporting strips are assigned to the wire foils and likewise extend transversely with respect to the movement direction of the wire, the wire foils or the supporting strips which are assigned to them being configured in their longitudinal direction with an undercut groove, and the supporting strips or the wire foils being configured with a spring which corresponds to the cross section of the undercut groove, and it being possible for the wire foils to be pushed with play onto the supporting strips transversely with respect to the movement direction of the wire, with the result that, in their operating position, they are fastened releasably to the supporting strips.

In prior art installations for producing paper which have a wire, wire foils which, furthermore, extend transversely with respect to the movement direction of the wire, are situated at a spacing from one another in the movement direction of the wire and with which the wire comes into contact, and supporting strips for the wire foils, which supporting strips are assigned to the wire foils and likewise extend transversely with respect to the movement direction of the wire, the wire foils are configured in their longitudinal direction with an undercut groove, and the supporting strips are configured with a spring which corresponds to the cross section of the undercut groove, with the result that the wire foils can be pushed with play onto the supporting strips transversely with respect to the movement direction of the wire, as a result of which they pass into their operating position, in which they are fastened releasably to the supporting strip.

Releasable fastening of the wire foils is therefore required, in order for it to be possible to replace them simply in the case where they are damaged.

However, this known type of fastening the wire foils to the supporting strips does not meet the requirements, since, as a result of the play which exists between the spring of the supporting strip and the groove of the wire foil and is required, in order for it to be possible to push the wire foil onto the supporting strip, the wire foil is not fastened rigidly to the supporting strip in its position, in which it is pushed onto the latter, but rather has a mobility which causes disadvantageous effects during operation of the installation. As a result, firstly, the wire foil does not have an exact position with respect to the wire, as a result of which, inter alia, the suction action cannot be fixed exactly, with the result that the paper quality is impaired and, furthermore, the wear of the wire foils is different, as a result of which the wire foils have different service lives. In addition, vibrations which can lead to damage of the supporting construction can occur during operation of the installation as a result of the mobility of the wire foils.

SUMMARY OF THE INVENTION

It is accordingly an object of the invention to provide a device for releasable fastening a wire strip in a paper-making installation which overcome the above-mentioned disadvantages of the heretofore-known devices and methods of this general type and which makes it possible to fasten a wire foil rigidly on the supporting strip that is assigned to it after it has been pushed onto said supporting strip, in order, as a result, to avoid the disadvantages which occur in the case of the known fastening of the wire foil on the supporting strip.

With the foregoing and other objects in view there is provided, in accordance with the invention, a device for releasably fastening a wire foil to a supporting strip in a paper-production installation having a wire and wire foils supported on supporting strips extending transversely with respect to a movement direction of the wire and spaced apart at a mutual spacing in the movement direction of the wire. The device comprises:

the supporting strip for the wire foil or the wire foil having an undercut groove formed in a longitudinal direction thereof, and the supporting strip or the wire foil being configured with a spring having a cross section corresponding to a cross section of said undercut groove;

said wire foil and said supporting strip being configured to enable said wire foil to be pushed with play onto said supporting strip transversely with respect to the movement direction of the wire;

a clamping strip extending in a longitudinal direction of the supporting strip and the wire foil and disposed between the supporting strip and the wire foil, wherein a displacement of said clamping strip in the longitudinal direction causes a transverse movement of the wire foil with respect to the supporting strip and, as a result, to rigidly lock the wire foil in an operating position thereof to the supporting strip.

In other words, the objects of the invention are achieved by virtue of the fact that a clamping strip, which extends in the longitudinal direction of the supporting strip and the wire foil, is provided between the supporting strip and the wire foil, the displacement of said clamping strip in its longitudinal direction bringing about a transverse movement of the wire foil with respect to the supporting strip, as a result of which, in its operating position, the wire foil is connected rigidly to the supporting strip.

The supporting strip and the wire foil are preferably configured on their side faces with faces which are assigned to one another, extend in the shape of a wedge and come into contact with one another as a result of a transverse movement of the wire foil with respect to the supporting strip, which transverse movement is brought about by means of the displacement of the clamping strip, as a result of which the wire foil is clamped with the supporting strip.

According to one preferred embodiment, the clamping strip is configured with slots which extend in its longitudinal direction and are penetrated by pins which are fastened to the supporting strip, a displacement of the clamping strip bringing about a transverse movement of the wire foil with respect to the supporting strip. Here, the slots which are provided in the clamping strip and extend in its longitudinal direction enclose, together with the longitudinal extent of the wire foil, an acute angle of from approximately 3° to approximately 10°. The preferred angle is 6°. Furthermore, the clamping strip can preferably be latched with the supporting strip in its end position which clamps the wire foil and the supporting strip to one another and/or in the other end position.

According to a further preferred embodiment, the clamping strip is configured with a laterally projecting spring element which is stressed by a displacement of the clamping strip in the direction toward clamping the wire foil with the supporting strip and by way of which the wire foil is loaded toward displacement transversely with respect to its longitudinal extent into its clamped position with the supporting strip. Furthermore, the clamping strip can be formed by a plurality of clamping strip parts which can be coupled to one another.

Other features which are considered as characteristic for the invention are set forth in the appended claims.

Although the invention is illustrated and described herein as embodied in a device for releasably fastening a wire foil in an installation for producing paper, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
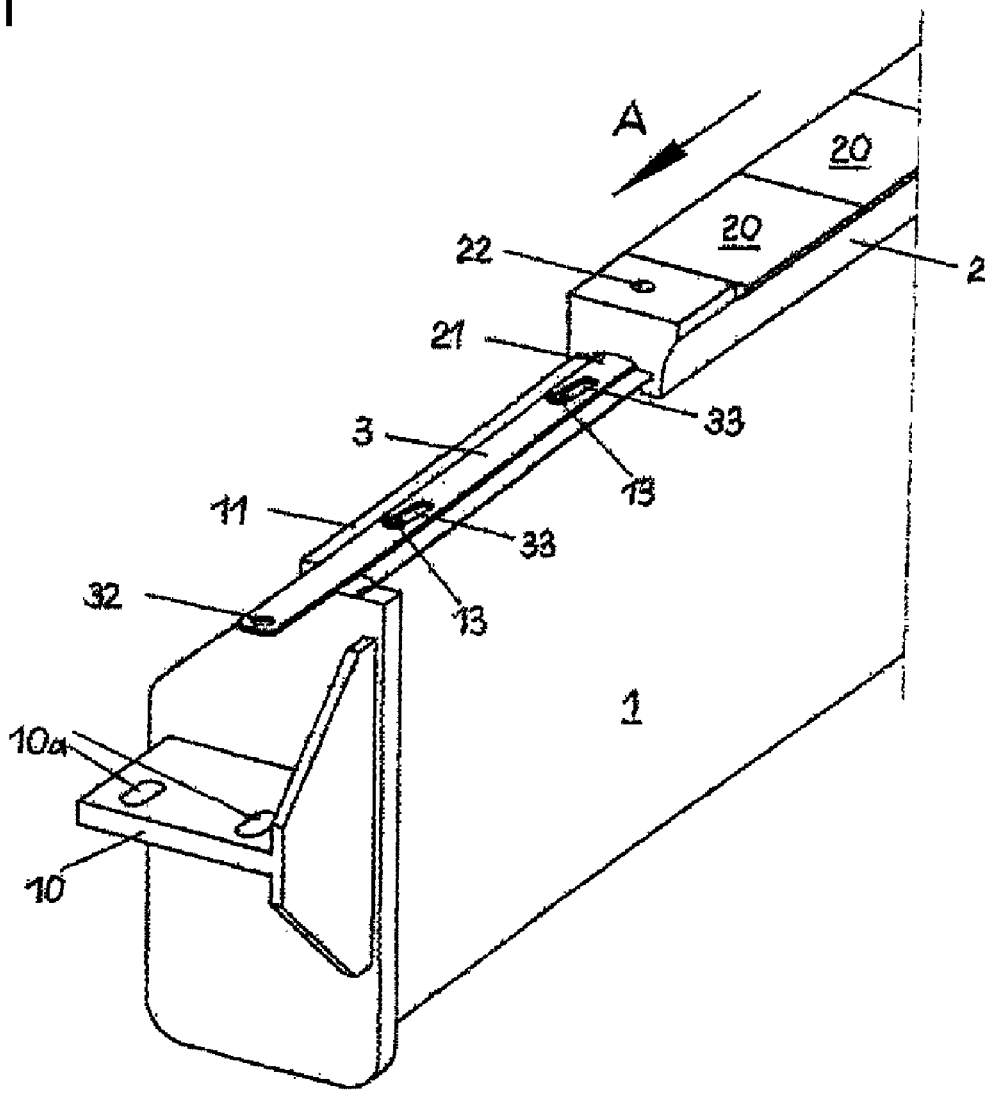
FIG. 1 is an axonometric illustration of a supporting strip in an installation for paper production, onto which supporting strip a wire foil is pushed, and a clamping strip according to the invention.

Referring now to the figures of the drawing in detail and first, particularly, to FIG. 1 thereof, there is shown a supporting strip 1, on which a wire foil 2 is to be fastened. The supporting strip 1 which can be fastened to a supporting frame by means of connecting flanges 10 or the like is configured on its upper side with an undercut strip 11 which serves to fasten the wire foil 2 to the supporting strip 1. For this purpose, the wire foil 2 is configured on its side which faces the supporting strip 1 with an undercut groove 21, the cross section of which is configured to be approximately mirror-inverted with respect to the cross section of the strip 11, with the result that the wire foil 2 can be pushed onto the strip 11 by means of the groove 21, as is indicated by the arrow A, and the wire foil 2 is fastened to the supporting strip 1 by means of a tongue and groove connection. On its upper side which faces the wire in an installation for paper production, the wire foil 2 is coated with wear elements 20 made from a ceramic material. Furthermore, the wire foil 2 is configured at its front end with a gripping hole 22 for its displacement by means of a tool. Furthermore, the connecting flange 10 is configured with recesses 10*a*, into which pins can be inserted for fastening the supporting strip 1 to the supporting frame.

As a result of this type of fastening, the wire foil 2 can be exchanged in a simple way in the case where it is no longer functional, since, for example, one of the wear elements 20 is damaged.

A further strip which, as is explained in the following text, serves as clamping strip 3 is situated between the strip 11 and the wire foil 2. Said clamping strip 3 is configured with slots 33 which extend in its longitudinal direction and are penetrated by pins 13 which protrude from the supporting strip 1. The clamping strip 3 can be displaced between two end positions by means of the pins 13 which penetrate the slots 33. The clamping strip 3 is also configured with a hole 32 for inserting a tool in order to move it. With respect to the longitudinal direction of the clamping strip 3, the slots 33 extend at an angle of approximately 6°.

Figure 2:
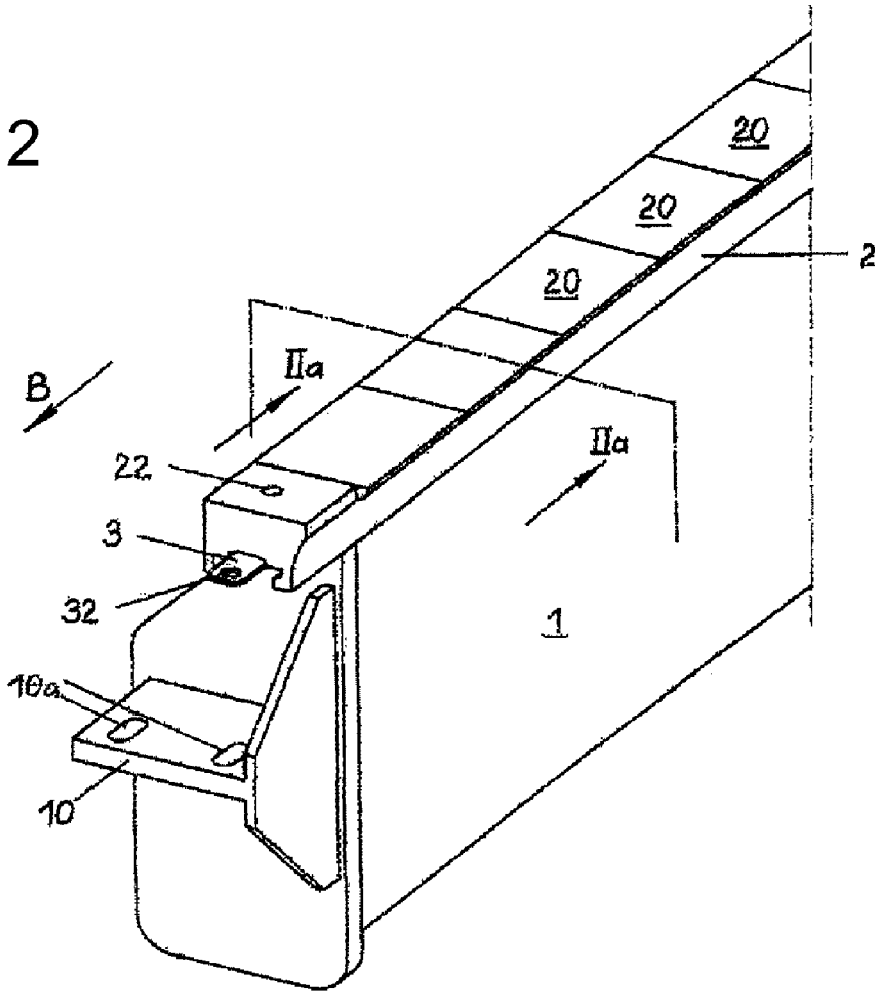
FIG. 2 is an axonometric illustration of the supporting strip according to FIG. 1, onto which a wire foil has been pushed completely, and the clamping strip.
Figure 2A:
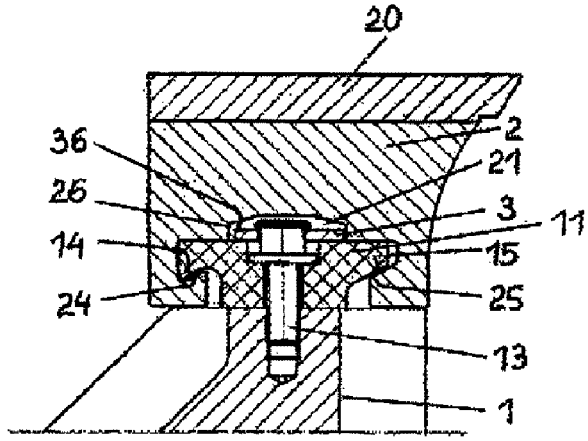
FIG. 2*a* shows the section according to the plane IIa-IIa of FIG. 2.

FIG. 2 shows that position of the wire foil 2, in which it is pushed completely onto the supporting strip 1. Furthermore, as can be seen from FIG. 2*a*, firstly the strip 11 is configured with two oblique faces 14 and 15, and secondly the groove 21 which is situated in the wire foil 2 is configured with two oblique faces 24 and 25 which are assigned to the oblique faces 14 and 15, the oblique faces 14 and 15 and 24 and 25 which are assigned to one another being situated at a slight spacing from one another in a first end position of the clamping strip 3 which is shown in FIG. 1 and FIG. 2. In addition, the left side edge 36 of the clamping strip 3 is situated at a spacing from the left inner face 26 of the groove 21. Since the wire foil 2 can be displaced with respect to the supporting strip 1 as a result, the wire foil 2 can be pushed onto the supporting strip 1 or can be pulled off from the latter, in order to be exchanged.

Figure 3:
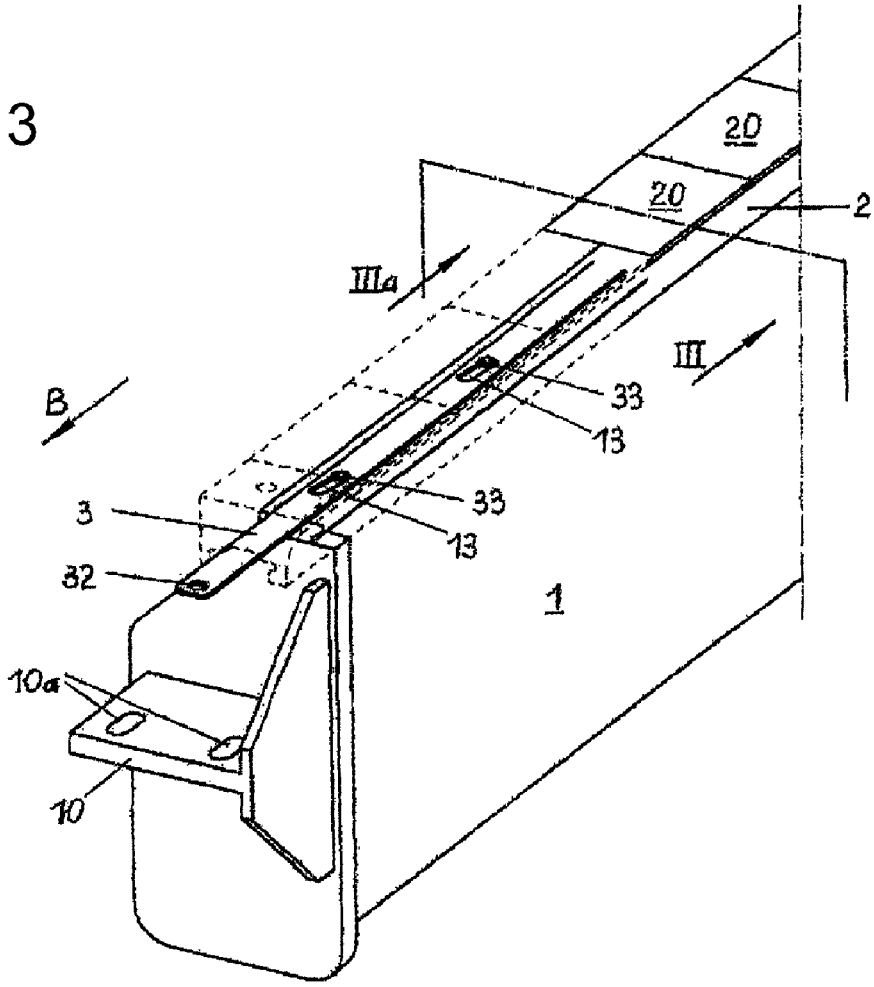
FIG. 3 shows the supporting strip and the wire foil which is pushed onto it, and the clamping strip in a first operating position, in an axonometric, partly opened-up illustration.
Figure 3A:
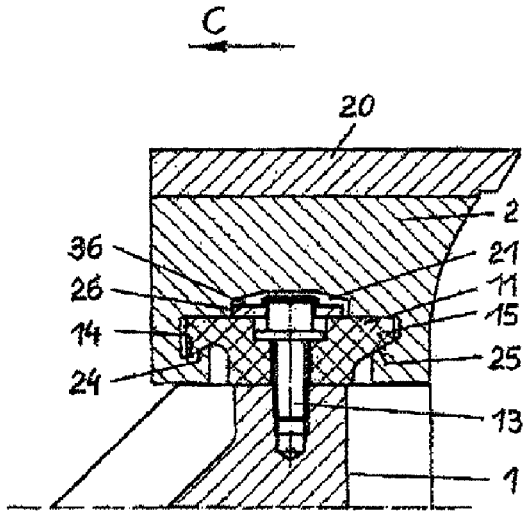
FIG. 3*a* shows the section according to the plane IIIa-IIIa of FIG. 3.

As soon as the clamping strip 3 is displaced in the direction of the arrow B, this has the result, on account of the oblique course of the slots 33, that the wire foil 2 is displaced to the left in the direction of the arrow C, as a result of which its left side edge 36 comes into contact with the left side wall 26 of the groove 21, which left side wall 26 lies opposite said left side edge 36, and displaces the wire foil 2 in the direction of the arrow C in the case of a further displacement of the clamping strip 3, with the result that the oblique faces 14 and 24 and 15 and 25 which are assigned to one another are pressed onto one another. Reference is made in this regard to FIG. 3 and FIG. 3*a*.

As a result, the wire foil 2 is clamped with the supporting strip 1, as a result of which the wire foil 2 is fastened rigidly to the supporting strip 1.

In addition to this, it is noted that, as a result of the movement of the wire which takes place in the direction of the arrow C, a force component which acts in this direction is exerted on the wire foil, as a result of which the tongue and groove connection shown is loaded in the direction of increasing the clamping action.

In order for it to be possible to pull off the wire foil 2 from the supporting strip 1 again, the clamping strip 3 has to be displaced counter to the direction of the arrow B into its first end position.

Figure 4:
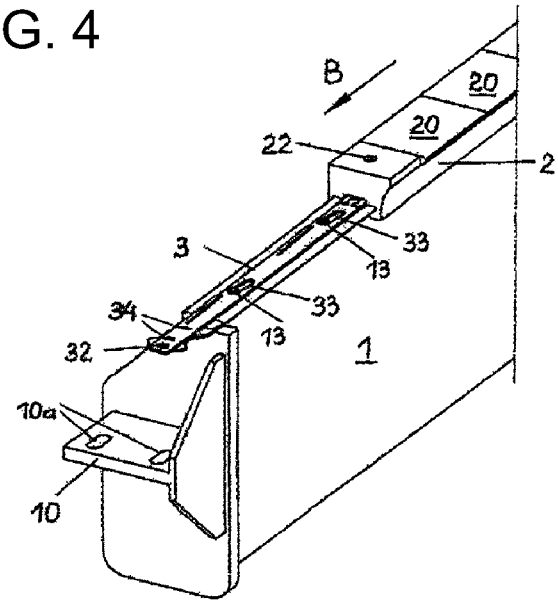
FIG. 4, FIG. 4*a*, FIG. 4*b* show the supporting strip and the wire foil according to FIG. 1 in different mutual positions, and one design variant of the clamping strip in two different operating positions, in each case in an axonometric illustration.
Figure 4A:
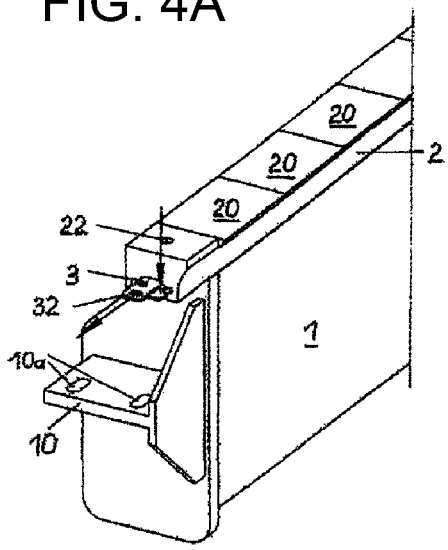
Figure 4B:
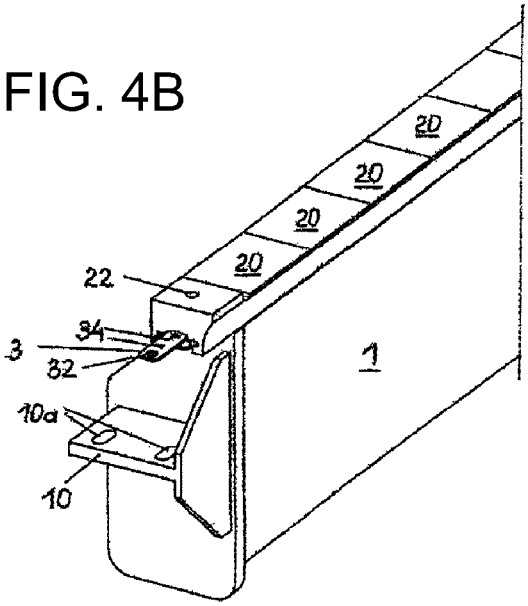
Figure 5:
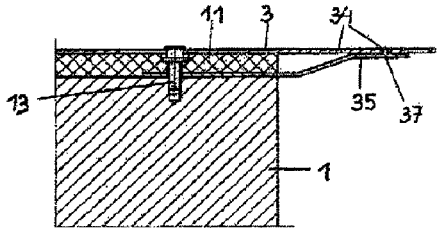
FIG. 5, FIG. 5*a*, FIG. 5*b*, FIG. 5*c* show a detail of the clamping strip, in different operating positions, in each case in a longitudinal section.
Figure 5A:
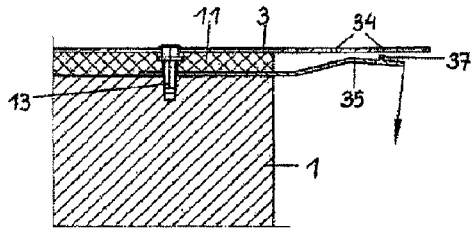
Figure 5B:
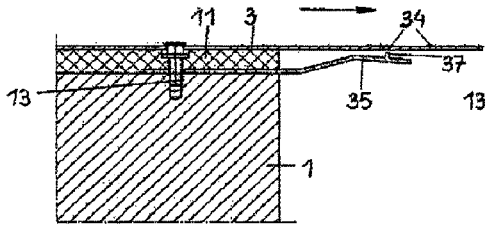
Figure 5C:
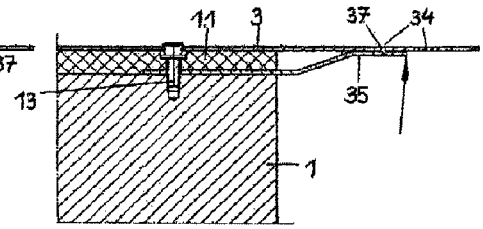

As is shown, furthermore, in FIG. 4, FIG. 4*a* and FIG. 4*b* and in FIG. 5, FIG. 5*a*, FIG. 5*b* and FIG. 5*c*, the clamping strip 3 is configured according to a further embodiment with latching slots 34 which are assigned a latching element 37 which projects from a spring plate 35 and latches into the latching slots 34 in the two end positions of the clamping strip 3, as a result of which the clamping strip 3 can be fixed in its two end positions.

Figure 6:
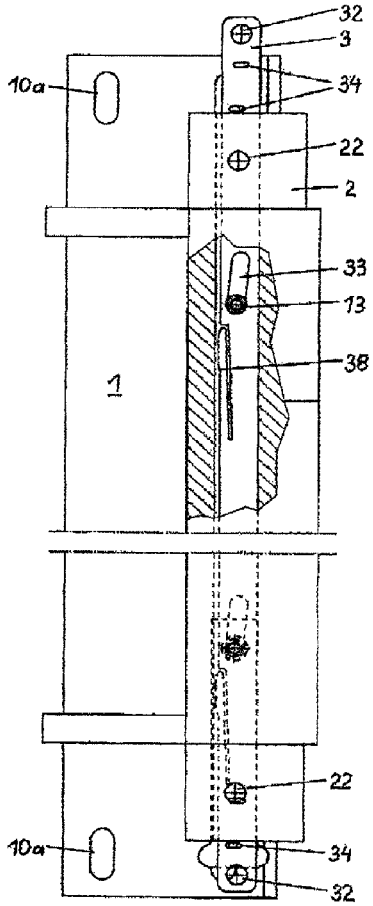
FIG. 6, FIG. 6*a* show a further detail of the clamping strip in two different operating positions, in each case in plan view and partly opened up.
Figure 6A:
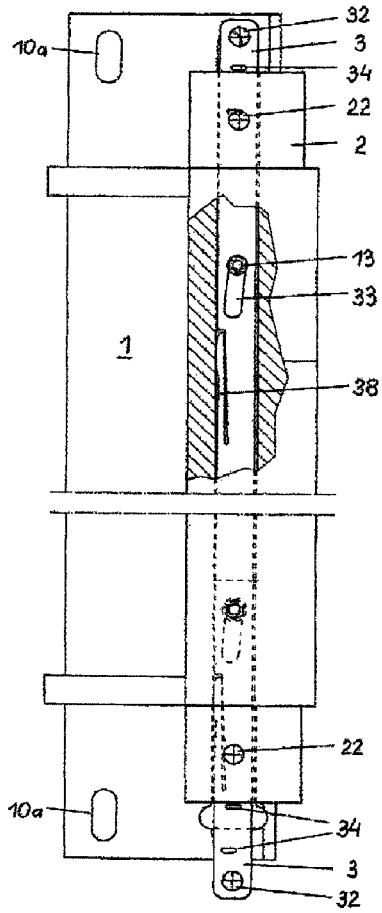

As can be seen, furthermore, from FIG. 6 and FIG. 6*a*, according to a further embodiment, the clamping strip 3 is configured at both of its ends with latching slots 34 and can be displaced from its two sides between the two end positions, depending on its position the wire foil 2 being clamped with the supporting strip 1 or it being possible to displace the wire foil 2 with respect to the supporting strip 1.

Furthermore, the clamping strip 3 is configured at its left side edge with a spring element 38 which is stressed by a displacement of the clamping strip 3 into its position which clamps the wire foil 2 with the supporting strip 1, or which exerts a pressure on the wire foil 2 in the direction of it being clamped with the supporting strip 1. The purpose of said spring element 38 comprises compensating for possible manufacturing tolerances to the extent that, although the clamping strip 3 has passed into its second end position, complete clamping of the wire foil 2 with the supporting strip 1 has not been brought about, that is to say bringing about the clamping of the supporting strip 1 with the wire foil 2 regardless of this.

Figure 7:
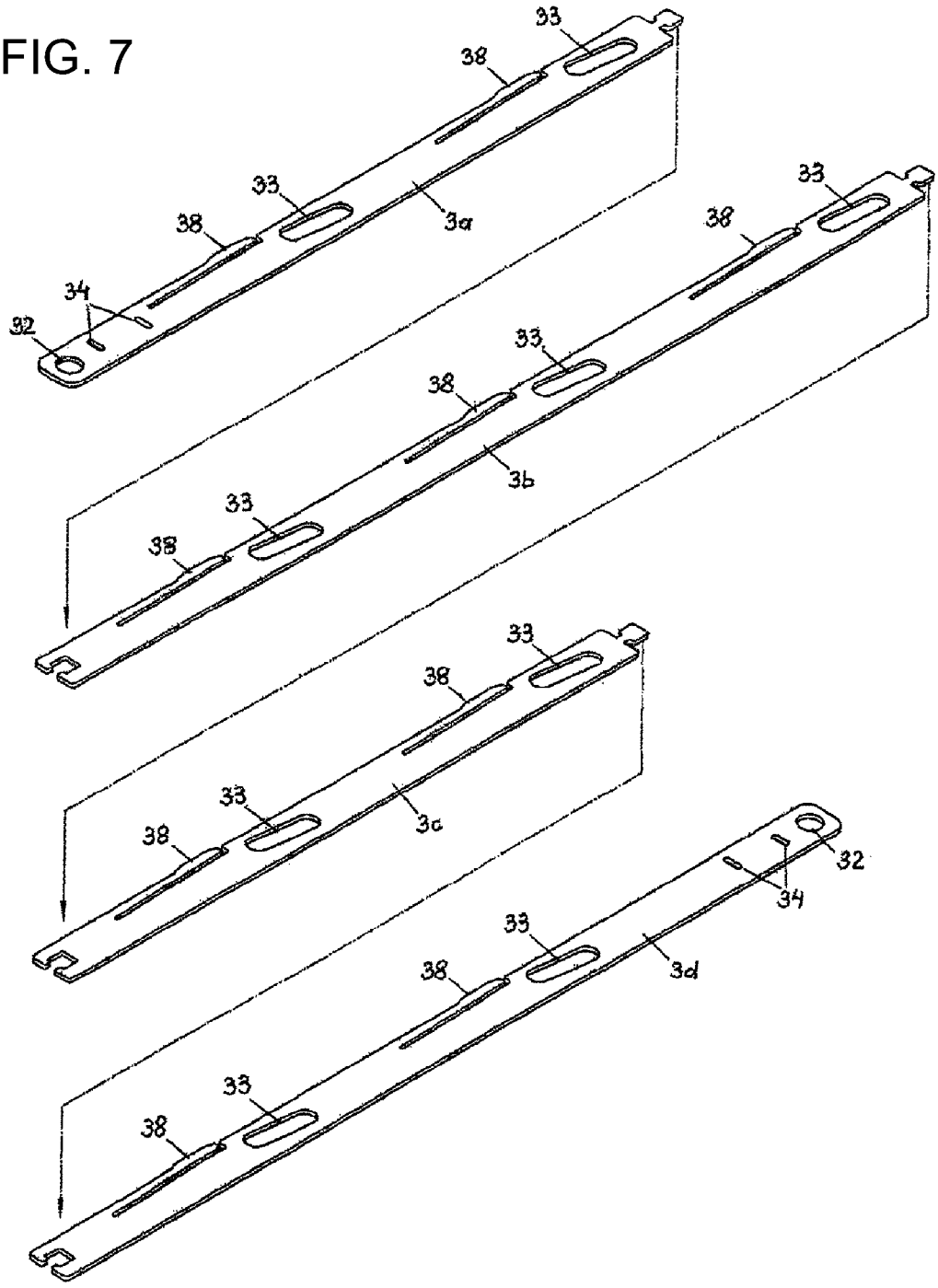
FIG. 7 shows a multiple-part clamping strip, in an exploded axonometric illustration.

As is shown in FIG. 7, the clamping strip 3 can comprise individual clamping strip parts 3*a*, 3*b*, 3*c* and 3*d* or else further clamping strip parts, the ends of which can be coupled positively to one another, as a result of which clamping strips of any desired length can be manufactured by means of a set of clamping strip parts of this type.

This achieves a simplification in manufacturing, in marketing, and in stock management and warehousing.

The invention claimed is:

1. In a paper-production installation having a wire and wire foils supported on supporting strips extending transversely with respect to a movement direction of the wire and spaced apart at a mutual spacing in the movement direction of the wire, a device for releasably fastening a wire foil to a supporting strip, the device comprising:

the wire foil having an undercut groove formed in a longitudinal direction thereof, and the supporting strip or the wire foil being configured with a spring having a cross section corresponding to a cross section of said undercut groove;

said wire foil and said supporting strip being configured to enable said wire foil to be pushed with play onto said supporting strip transversely with respect to the movement direction of the wire;

a clamping strip extending in a longitudinal direction of the supporting strip and the wire foil and disposed between the supporting strip and the wire foil, wherein a displacement of said clamping strip in the longitudinal direction causes a transverse movement of the wire foil with respect to the supporting strip and in the movement direction of the wire and, as a result, to rigidly lock the wire foil in an operating position thereof to the supporting strip.

2. The device according to claim 1, wherein the supporting strip and the wire foil are configured on their sides with mutually assigned side faces extending in the shape of a wedge and coming into contact with one another as a result of a transverse movement of the wire foil with respect to the supporting strip, wherein the transverse movement is brought about by way of the displacement of the clamping strip, and the wire foil is clamped with the supporting strip.

3. The device according to claim 1, wherein said clamping strip is formed with slots extending in the longitudinal direction thereof and the supporting strip carries pins penetrating through said clamping strip, and wherein the displacement of said clamping strip brings about a transverse movement of the wire foil with respect to the supporting strip.

4. The device according to claim 3, wherein said slots formed in said clamping strip and a longitudinal extent of the wire foil enclose an acute angle between approximately 3° and approximately 10°.

5. The device according to claim 4, wherein said slots in said clamping strip and said wire foil enclose an acute angle of approximately 6°.

6. The device according to claim 1, wherein said clamping strip is latched with the supporting strip in an end position in which the wire foil and the supporting strip are clamped to one another.

7. The device according to claim 6, wherein said clamping strip is latched with the supporting strip in an end position opposite from the end position in which the wire foil and the supporting strip are clamped to one another.

8. The device according to claim 1, wherein said clamping strip is configured with a laterally projecting spring element that is stressed by a displacement of said clamping strip in a direction toward clamping the wire foil with the supporting strip and by way of which the wire foil is loaded toward displacement transversely with respect to the longitudinal extent thereof into a clamped position with the supporting strip.

9. The device according to claim 1, wherein said clamping strip is formed of a plurality of clamping strip parts that are coupled to one another.

10. In a paper-production installation having a wire and wire foils supported on supporting strips extending transversely with respect to a movement direction of the wire and spaced apart at a mutual spacing in the movement direction of the wire, a device for releasably fastening a wire foil to a supporting strip, the device comprising:

the wire foil having an undercut groove formed in a longitudinal direction thereof, and the supporting strip or the wire foil being configured with a spring having a cross section corresponding to a cross section of said undercut groove;

said wire foil and said supporting strip being configured to enable said wire foil to be pushed with play onto said supporting strip transversely with respect to the movement direction of the wire;

a clamping strip extending in a longitudinal direction of the supporting strip and the wire foil and disposed between the supporting strip and the wire foil, wherein a displacement of said clamping strip in the longitudinal direction causes a transverse movement of the wire foil with respect to the supporting strip and in the movement direction of the wire and, as a result, to rigidly lock the wire foil in an operating position thereof to the supporting strip substantially without a movement thereof in a direction perpendicular to a plane of the wire.

11. In a paper-production installation having a wire and wire foils supported on supporting strips extending transversely with respect to a movement direction of the wire and spaced apart at a mutual spacing in the movement direction of the wire, a device for releasably fastening a wire foil to a supporting strip, the device comprising:

the wire foil having an undercut groove formed in a longitudinal direction thereof, and the supporting strip or the wire foil being configured with a spring having a cross section corresponding to a cross section of said undercut groove;

said wire foil and said supporting strip being configured to enable said wire foil to be pushed with play onto said supporting strip transversely with respect to the movement direction of the wire;

a clamping strip extending in a longitudinal direction of the supporting strip and the wire foil and disposed between the supporting strip and the wire foil, wherein a displacement of said clamping strip in the longitudinal direction causes a transverse movement of the wire foil with respect to the supporting strip and, as a result, to rigidly lock the wire foil in an operating position thereof to the supporting strip; and wherein said clamping strip is latched with the supporting strip in an end position in which the wire foil and the supporting strip are clamped to one another.

12. The device according to claim 11, wherein said clamping strip is latched with the supporting strip in an end position opposite from the end position in which the wire foil and the supporting strip are clamped to one another.

* * * * *